US009188003B2

(12) United States Patent
Chen et al.

(10) Patent No.: US 9,188,003 B2
(45) Date of Patent: Nov. 17, 2015

(54) VARIABLE VALVE UNIVERSAL BRACKET DESIGN

(71) Applicant: Schaeffler Technologies AG & Co. KG, Herzogenaurach (DE)

(72) Inventors: Xuewei Chen, Novi, MI (US); Anna Strehlau, Windsor (CA); Jesse Myers, Waterford, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 351 days.

(21) Appl. No.: 13/767,544

(22) Filed: Feb. 14, 2013

(65) Prior Publication Data

US 2013/0205992 A1 Aug. 15, 2013

Related U.S. Application Data

(60) Provisional application No. 61/599,097, filed on Feb. 15, 2012.

(51) Int. Cl.

| | |
|---|---|
| ***F01B 31/00*** | (2006.01) |
| ***F01L 9/02*** | (2006.01) |
| *F01L 1/24* | (2006.01) |

(52) U.S. Cl.

CPC . *F01B 31/00* (2013.01); *F01L 9/02* (2013.01); *F01L 9/025* (2013.01); *F01L 2001/2444* (2013.01); *F01L 2103/00* (2013.01); *F01L 2103/01* (2013.01)

(58) Field of Classification Search

CPC ..... F01B 31/00; F01L 9/025; F01L 9/02; F01L 2103/00; F01L 2103/01

USPC ..... 137/343, 377, 884; 248/65

See application file for complete search history.

(56) References Cited

U.S. PATENT DOCUMENTS

| | | | | |
|---|---|---|---|---|
| 3,357,664 | A * | 12/1967 | Geyer | 248/74.4 |
| 5,839,400 | A | 11/1998 | Vattaneo et al. | |
| 5,960,776 | A | 10/1999 | Everingham et al. | |
| 6,056,136 | A | 5/2000 | Taber et al. | |
| 6,607,172 | B1 | 8/2003 | Green et al. | |

FOREIGN PATENT DOCUMENTS

| | | | |
|---|---|---|---|
| KR | 19990033341 | A | 5/1999 |
| KR | 20100022652 | A | 3/2010 |
| KR | 20110003875 | A | 1/2011 |

OTHER PUBLICATIONS

International Search Report for PCT/US2013/026167, mailed Jun. 25, 2013 by the Korean Intellectual Property Office.

* cited by examiner

*Primary Examiner* — Craig Schneider
*Assistant Examiner* — Nicole Wentlandt
(74) *Attorney, Agent, or Firm* — Antun M. Peakovic

(57) ABSTRACT

A universal multi-orientation bracket design for attaching solenoids to a housing of a hydraulically actuated variable valve system. The bracket having at least two sidewalls, an upper cross member, a cupped lower surface and at least one mounting flange. The cupped lower surface is shaped to insert a solenoid main body and gaps included in the side walls for a protruding solenoid connector.

8 Claims, 6 Drawing Sheets

VARIABLE VALVE UNIVERSAL BRACKET DESIGN

The present invention relates to a universal bracket design for attachment of solenoids to a variably actuated valve system.

BACKGROUND

Variable valve hydraulically actuated valve systems are known in the art. An example system is disclosed in U.S. Pat. No. 5,839,400, wherein a multi-cylinder internal combustion engine has two intake valves for each cylinder which can be uncoupled from the respective tappets by drawing fluid under pressure out of a chamber interposed between each tappet and the respective valve. The system is a fully variable hydraulic valve control module utilizing individual solenoid valves. U.S. Pat. No. 5,839,400 is incorporated by reference as though fully set forth herein.

In hydraulically actuated valve systems, such as that shown in U.S. Pat. No. 6,056,136, the solenoid valves are assembled to the external surface of the housing of the system using a cold forming attachment process, such as swaging or clinching. As such cold forming attachment is used, restrictions on type of material that would accommodate for cold forming are needed. Orientation of the solenoid oil galleries within the actuator housing are essential to the proper functioning of the system, as such, precise positioning of the solenoid valves is required during the attachment process. Once installed, the solenoid valves are not removable or replaceable, therefore, in the event of a solenoid failure during assembly or in operation, the entire actuator would need to be replaced.

SUMMARY OF THE INVENTION

Certain terminology is used in the following description for convenience and descriptive purposes only, and is not intended to be limiting to the scope of the claims. The terminology includes the words specifically noted, derivatives thereof and words of similar import.

The present invention relates to a universal orientation bracket design for attaching or securing solenoids to a housing of a hydraulically actuated variable valve system. The bracket has at least one attachment flange attached to a cupped or arched main body portion with an upper and lower surface. The main body portion, in turn, is made of at least two side walls connected with an upper cross member and at least one opening or gap between the side walls to allow for orientation of the solenoid valve, and accommodating the solenoid connector. The lower cupped surface of said main body is shaped in such a way as to accept, retain and orient a solenoid valve.

The particular shape of the bracket and the configuration and orientation of the arched main body, flanges and side walls, as to the associated housing and to each other, will necessarily depend on the needs of any particular application, and will be designed to suit a particular solenoid valve design.

An additional embodiment of the present invention is that the bracket provides for correct orientation of solenoids in several directions depending on the attachment orientation to the hydraulically actuated valve system housing.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION OF THE INVENTION

Identically labeled elements appearing in different ones of the figures refer to the same elements but may not be referenced in the description for all figures. The exemplification set out herein illustrates at least one embodiment, in at least one form, and such exemplification is not to be construed as limiting the scope of the claims in any manner.

Figure 1:
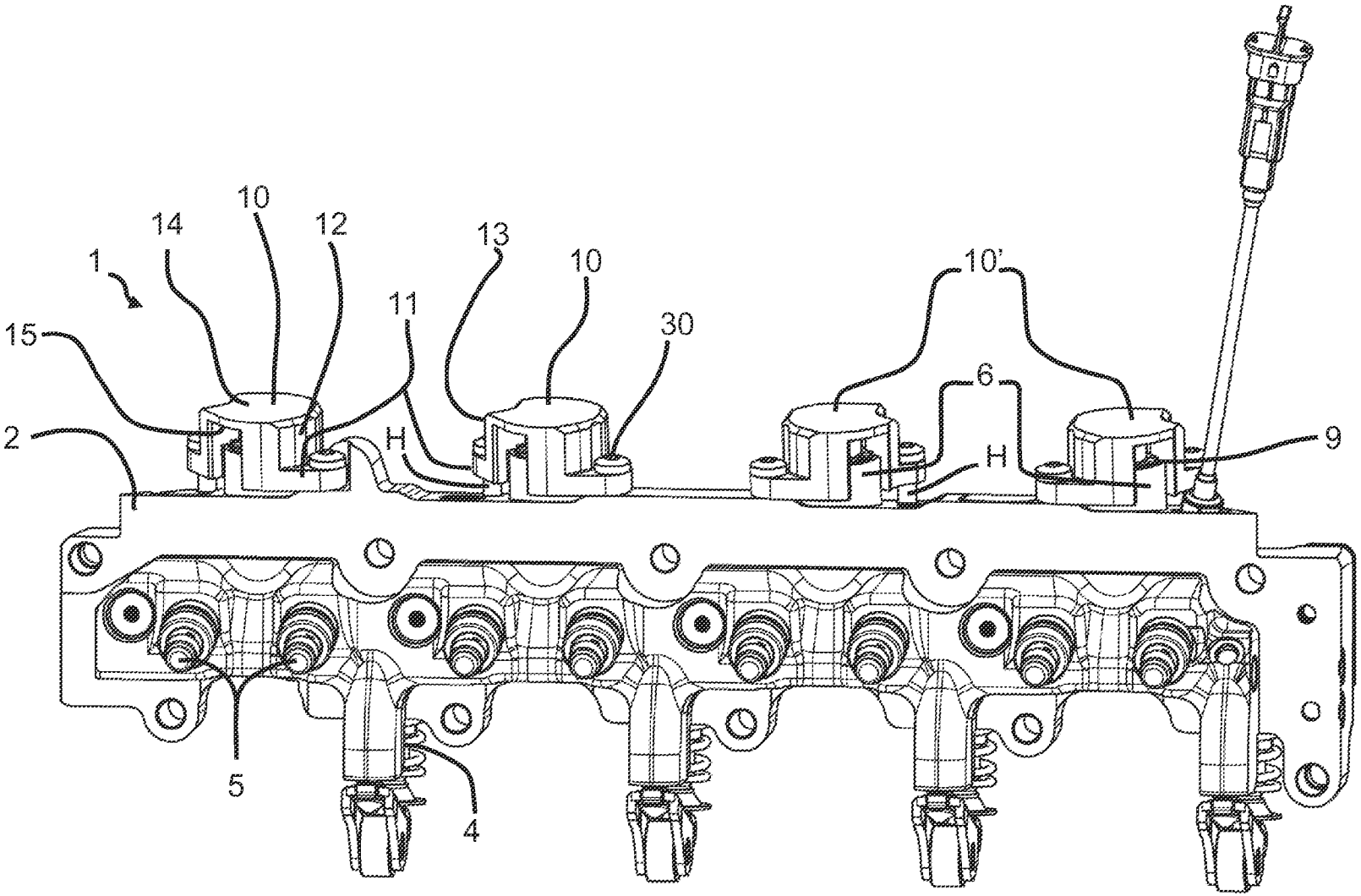
FIG. 1 is a perspective view of the bottom of a hydraulically actuated valve system, including the bracket and associated solenoid attached to the housing according to one embodiment of the invention.

FIG. 1 shows a perspective view of a hydraulic valve actuation system 1. Hydraulic valve actuation system 1 comprises housing 2, pumps 4 slidably mounted along an axis substantially directed at 90 degrees with respect to the axis of a brake or piston 5, in turn, in line with a valve stem (not shown), solenoids 6, and orientation bracket 10. The details of construction and operation of hydraulic valve actuation system 1, pumps 4 and brakes 5 are not described and shown herein. Solenoid 6 is oriented and fixed in position on housing 2 such that solenoid 6 is in line with an oil gallery 20 (see FIG. 8). As seen from this perspective view of the bottom of actuation system 1, bracket 10 comprises mounting flange 11, sidewall 12, second sidewall 13, upper cross member 14 and cupped lower surface 15. Solenoid 6 is seated within lower cupped surface 15, solenoid main body shoulder 9 contacting stepped surface 17 of bracket 10 (see FIG. 3) and oriented by sidewalls 12 and 13. Fasteners 30 are inserted through holes 16 in flange 11 and into housing 2. In this example embodiment, a gap H is maintained between flange 11 and the surface of housing 2, as, in this example embodiment, the surface of housing 2 is curved or angled, making proper seating of flange 11 on surface of housing 2 difficult. Stepped surface 17 of bracket 10 (see FIG. 3) seats on shoulders 9 of solenoid 6, and fasteners 30 extend through flange hole 16 and into housing mounting hole 31, maintaining gap H in this example embodiment. Brackets 10' are identical in shape and configuration to brackets 10, but mounted in a different orientation on housing 2 to accommodate for required solenoid 6 location within housing 2 or to avoid interference of housing fastener hole 31 with oil galleries and mounting surfaces (not shown) of housing 2. See FIG. 7.

Figure 2:
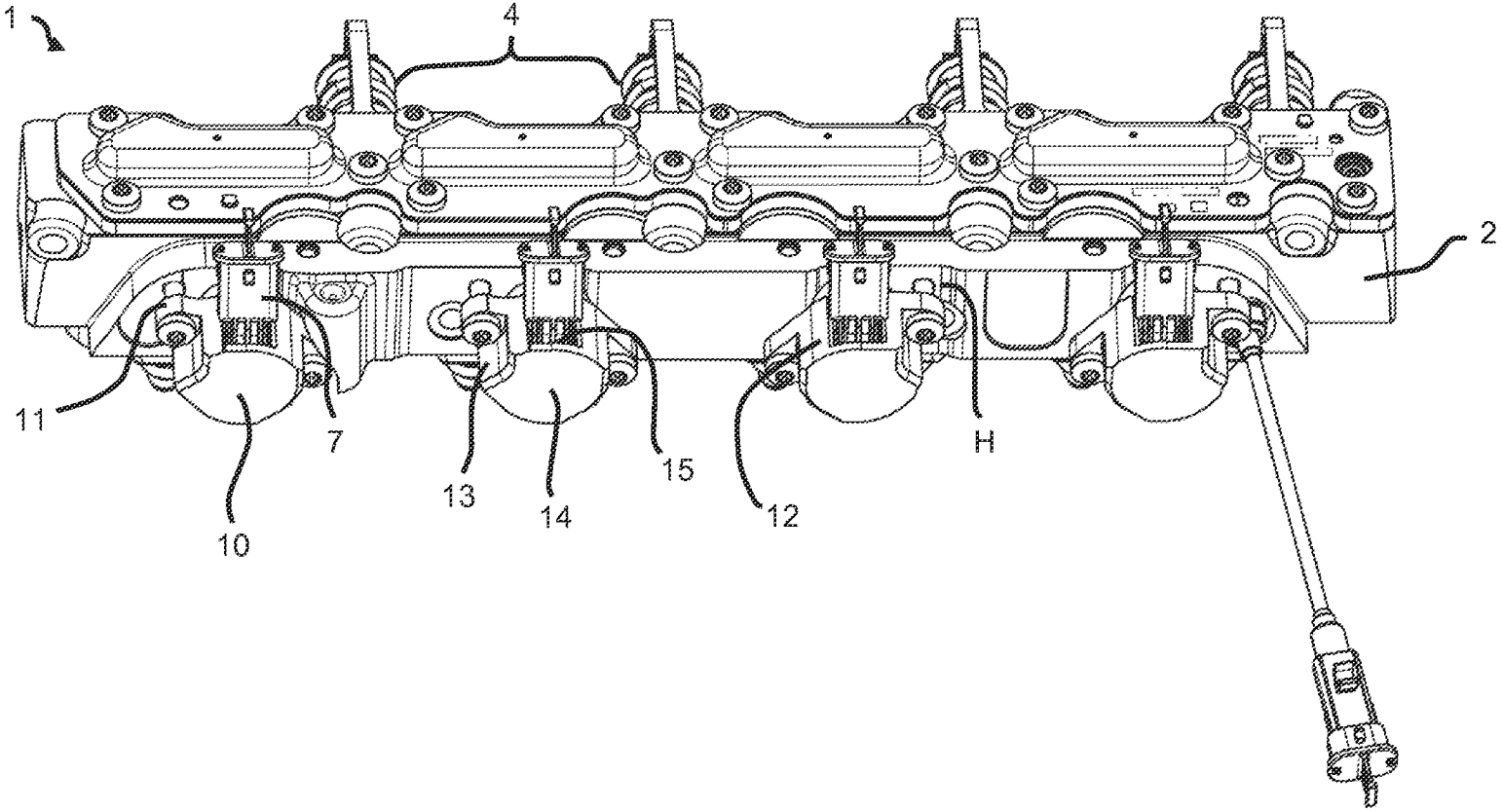
FIG. 2 is a perspective view of the top of an hydraulically actuated valve system, including the bracket and associated solenoid attached to the housing according to one embodiment of the invention.

FIG. 2 is a perspective view of the top of actuation system 1. Pumps 4 and solenoid connector 7, which is an extension from the main body of solenoid 6, are shown. Brackets 10 are shown, comprising mounting flange 11, sidewall 12, second sidewall 13, upper cross member 14 and cupped lower surface 15.

Figure 3:
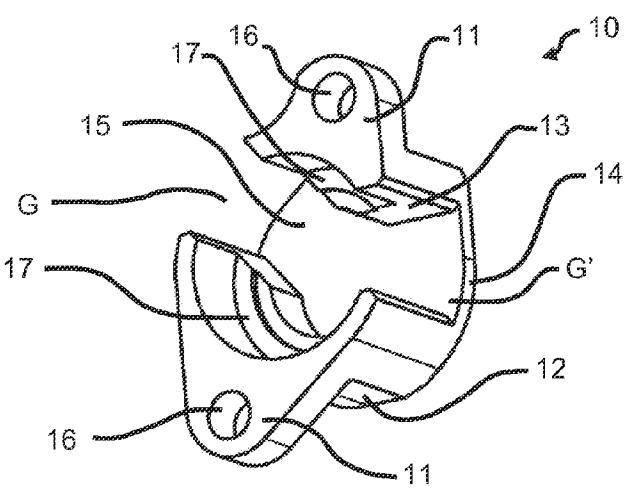
FIG. 3 is a perspective view of the bottom of the bracket design for a hydraulically actuated valve system according to one embodiment of the invention.

FIG. 3 is a perspective view of the bottom of bracket 10, comprising mounting flange 11, mounting flange fixation hole 16, sidewall 12, second sidewall 13, upper cross member 14, cupped lower surface 15, and stepped surface 17. Gaps G and G' are shown between sidewalls 12 and 13.

Figure 4:
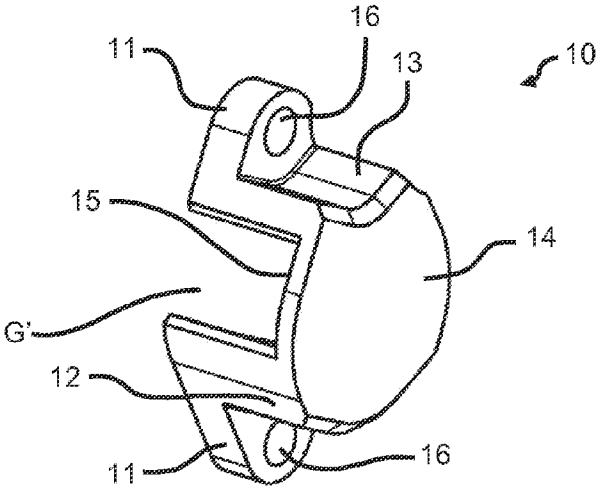
FIG. 4 is a perspective view of the top of the bracket design for a hydraulically actuated valve system according to one embodiment of the invention.

FIG. 4 is a perspective view of the top of bracket 10, comprising mounting flange 11, mounting flange fixation hole 16, sidewall 12, second sidewall 13, upper cross member 14 and cupped lower surface 15. A gap G' is shown between sidewalls 12 and 13.

Figure 5:
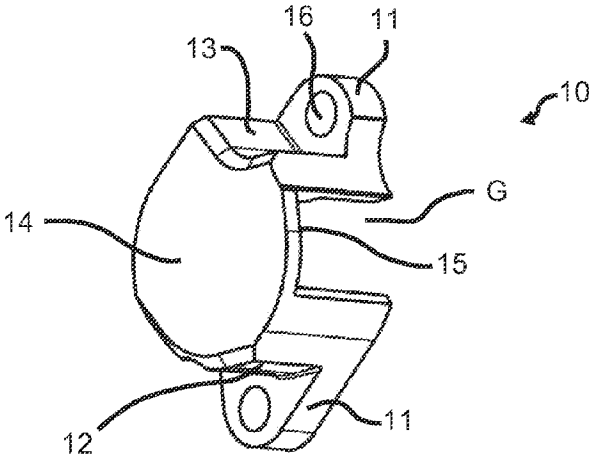
FIG. 5 is a perspective view of the side of the bracket design for a hydraulically actuated valve system according to one embodiment of the invention.

FIG. 5 is a perspective view of the top of bracket 10, comprising mounting flange 11, mounting flange fixation hole 16, sidewall 12, second sidewall 13, upper cross member 14 and cupped lower surface 15. A gap G is shown between sidewalls 12 and 13. Although at least one gap is needed between sidewalls 12 and 13 to accommodate for solenoid connector 7 (see FIG. 2), a second gap may be designed in order to accommodate a particular solenoid 6 or bracket 10 orientation on housing 2 to allow for multiple retention orientations of bracket 10 and solenoid 6 on housing 2.

Figure 6:
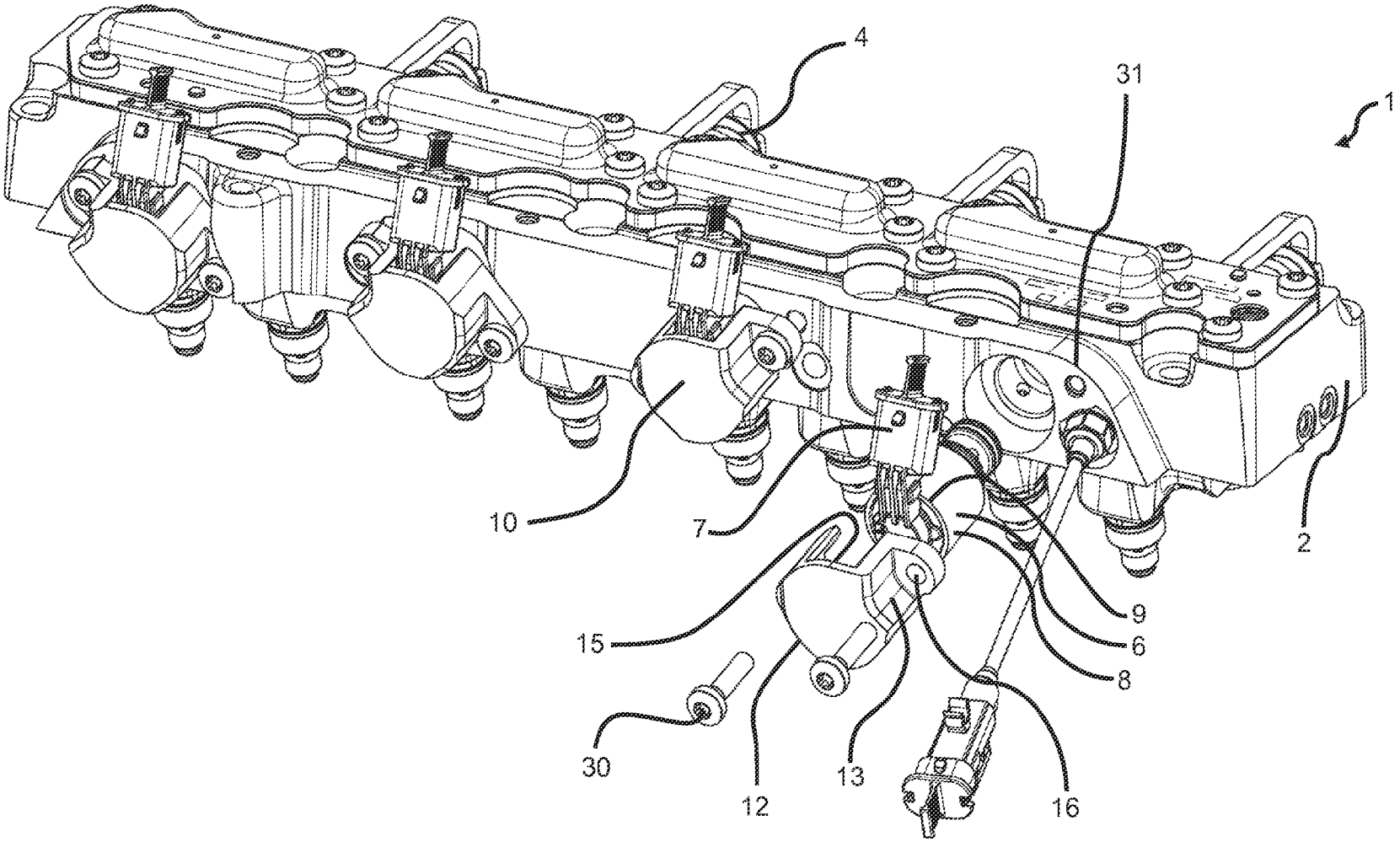
FIG. 6 is a perspective view of the top of a hydraulically actuated valve system, showing a partially exploded assembly view of a solenoid and bracket.

FIG. 6 is a perspective view of the top of hydraulically actuated valve system 1, showing a partially exploded assembly view of bracket 10 and solenoid 6. Solenoid 6 in this example embodiment comprises a rounded main body portion 8, shoulder 9 and connector 7. Body 8 of solenoid 6 slides into cupped lower surface 15 of bracket 10, shoulder 9 contacts and seats on stepped surface 17 and is oriented by side walls 12 and 13. Bracket 10 and retained solenoid 6 are fastened to housing 2 using fasteners 30, inserted through flange holes 16 and into retention holes 31 in housing 2. In this example embodiment, gap H (see FIGS. 1 and 2) is maintained between flange 11 and housing 2, as the surface of housing 2 is curved and contains multiple porting and mounting features. As can be more clearly seen in FIG. 7, bracket 10 may be oriented in several ways without changing the design of bracket 10, to accommodate for a required orientation of solenoid 6 within housing 2. Retention holes 31 must be moved to accommodate for shifting the orientation of bracket 10. In this example embodiment, bracket 10 is in a shallow "C" configuration and there are gaps G and G' between sidewalls 12 and 13 on opposite ends of bracket 10. This configuration allows for bracket 10 to be reversed into the orientation of bracket 10', maintaining the geometry of bracket 10 and accomplishing multiple orientation configurations and retention of solenoid 6. As bracket 10 is reversed in orientation on housing 2, connector 7 extends through gap G' rather than G, and solenoid 6 is correctly position into housing 2, as per any particular system design requirement.

Figure 7:
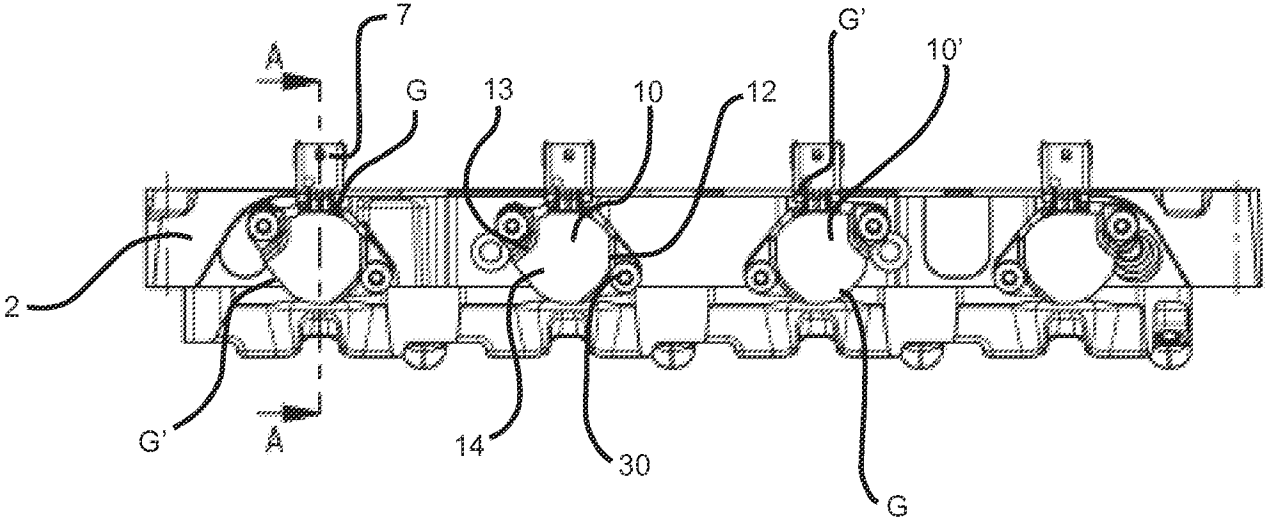
FIG. 7 is a side view of a hydraulically actuated valve system.
Figure 8:
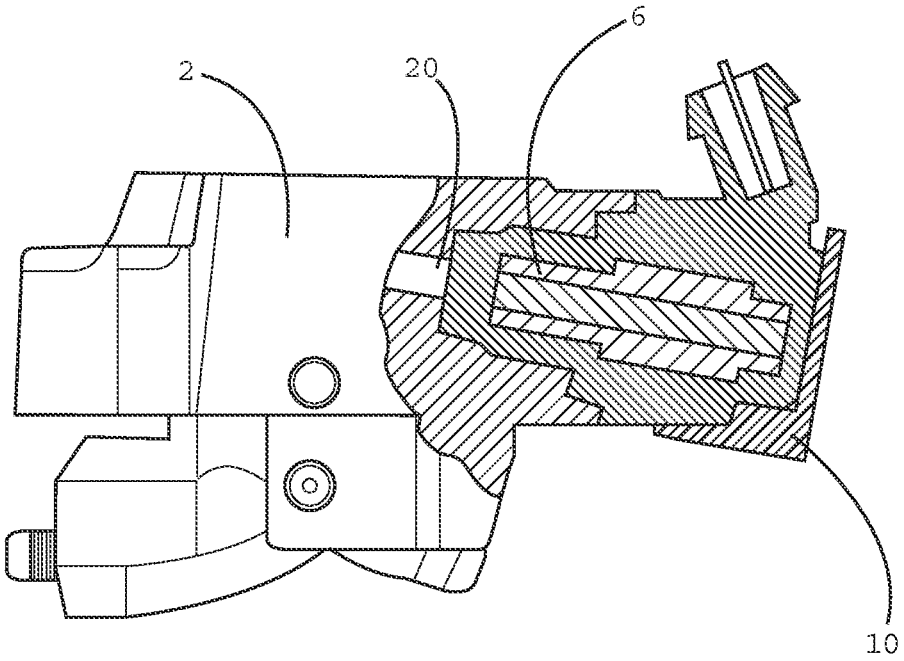
FIG. 8 is a cross section of a hydraulically actuated valve system taken along line A-A of FIG. 7.

FIG. 8 shows a cross section taken along line A-A of FIG. 7, showing solenoid 6 and connector 7 oriented into oil gallery 20 of housing 2, with the aid of bracket 10.

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

LIST OF REFERENCE SYMBOLS

1 Hydraulic Valve Actuation System
2 Housing
4 Pump
5 Piston or Brake
6 Solenoid
7 Solenoid Connector
8 Solenoid Body
9 Solenoid Shoulder
10 Orientation Bracket
10' Orientation Bracket
11 Mounting Flange
12 Side Wall
13 Side Wall
14 Upper Cross Member
15 Lower Cupped Surface
16 Flange Hole
17 Stepped Surface
20 Oil Gallery
30 Fasteners
31 Housing Fastener Hole

What we claim is:

1. A solenoid bracket assembly for a hydraulically actuated valve system comprising:

a bracket in a first position having at least two sidewalls, an upper cross member, a cupped lower surface, a first mounting flange at a first orientation and a second mounting flange at a second orientation;

a solenoid having a main body and a connector protruding from said main body;

said cupped lower surface cooperable with said main body to retain the main body within the bracket; and said side walls and said upper cross member forming at least one opening through which said connector may protrude;

wherein the first mounting flange and the second mounting flange are not symmetrical about the bracket with respect to the opening and when the bracket is rotated from the first position to a second position, the solenoid and the connector remain in the same orientation relative to the hydraulically actuated valve system.

2. The bracket assembly of claim 1, wherein said side walls said upper cross member define at least two openings.

3. The bracket assembly of claim 1, wherein said main body of said solenoid may be inserted into said cupped lower surface of said bracket in more than one orientation.

4. The bracket assembly of claim 1, wherein said side walls are curved surfaces.

5. The bracket assembly of claim 1, wherein said cupped lower surface includes a stepped shoulder on which said main body of said solenoid may seat.

6. A multi-orientation bracket for a hydraulically actuated valve system comprising;

at least two sidewalls, an upper cross member, and a cupped lower surface defining at least two openings; and, a first mounting flange at a first orientation and a second mounting flange at a second orientation, wherein the first mounting flange and the second mounting flange are not symmetrical about the upper cross member relative to the at least two openings.

7. The bracket of claim 6, wherein said side walls are curved surfaces.

8. The bracket assembly of claim 6, wherein said cupped lower surface includes a stepped shoulder.

* * * * *